US005155004A

United States Patent [19]

Kojima

[11] Patent Number: 5,155,004

[45] Date of Patent: Oct. 13, 1992

[54] CHITOSAN OR CHITIN DERIVATIVE AND METHOD FOR PROCESSING SILVER HALIDE PHOTOGRAPHIC MATERIAL BY USING THE SAME

[75] Inventor: Tetsuro Kojima, Kanagawa, Japan

[73] Assignee: Fuji Photo Film Co., Ltd., Kanagawa, Japan

[21] Appl. No.: 668,850

[22] Filed: Mar. 13, 1991

[30] Foreign Application Priority Data

Mar. 14, 1990 [JP] Japan ..... 2-63874

[51] Int. Cl.[5] ..... G03C 5/54; G03C 1/06

[52] U.S. Cl. ..... 430/223; 430/226; 430/376; 430/451; 430/455; 430/470; 430/491; 430/505; 430/512; 430/543; 430/544; 430/559; 430/566; 430/621; 430/957; 430/958

[58] Field of Search ..... 430/371, 434, 448, 507, 430/518, 523, 961, 223, 226, 376, 415, 451, 455, 470, 491, 505, 512, 543, 544, 559, 566, 621, 957, 958; 536/20

[56] References Cited

U.S. PATENT DOCUMENTS

| | | | |
|---|---|---|---|
| 2,669,529 | 2/1951 | Rust | 536/20 |
| 2,842,049 | 7/1958 | Delangre | 536/20 |
| 3,990,895 | 11/1976 | Land | 430/496 |
| 4,309,534 | 1/1982 | Austin | 536/20 |
| 4,675,245 | 6/1987 | Von Meer | 430/538 |
| 5,002,862 | 3/1991 | Yagihara et al. | 430/434 |

*Primary Examiner*—Hoa Van Le

*Attorney, Agent, or Firm*—Sughrue, Mion, Zinn, Macpeak & Seas

[57] ABSTRACT

A chitosan or chitin compound having a photographically useful residue. There is also disclosed a method for processing a silver halide photographic material which comprises processing a silver halide photographic material comprising a support having thereon at least one light-sensitive silver halide emulsion layer in the presence of said chitosan or chitin compound represented by the following general formula (I)

(I)

wherein the substituents are defined in the instant specification.

6 Claims, No Drawings

CHITOSAN OR CHITIN DERIVATIVE AND METHOD FOR PROCESSING SILVER HALIDE PHOTOGRAPHIC MATERIAL BY USING THE SAME

FIELD OF THE INVENTION

The present invention relates to a novel chitosan or chitin derivative. It also relates to a method for processing silver halide photographic materials in the presence of said chitosan or chitin derivative.

BACKGROUND OF THE INVENTION

Many attempts have been conventionally made to increase the molecular weights of various compounds which are to be contained in silver halide photographic materials or in developing solutions for use in the development of the photographic materials.

For example, attempts have been made to increase the molecular weights of stabilizers such as mercapto group-substituted heterocyclic compounds which prevent fogging from being caused by the formation of a nucleus which induces development even when silver halide photographic materials are not subjected to exposure to thereby prevent the compounds from being diffused in adjacent light-sensitive layers and from being dissolved out into processing solutions and to thereby prevent a reduction in spectral sensitivity from being caused by the desorption of sensitizing dyes.

There are disclosed high-molecular compounds having repeating units, as residues of stabilizer, derived from thiazoles (U.S. Pat. No. 3,598,599), tetrazoles (U.S. Pat. Nos. 3,576,638 and 4,134,768), imidazoles (U.S. Pat. No. 3,598,600), tetraazaindenes (JP-A-57-211142 (the term "JP-A" as used herein means an "unexamined published Japanese patent application")), benztriazoles (JP-A-59-90844), oxadiazoles, thiadiazoles, selenadiazoles and triazoles (JP-A-62-949), mercaptotetraazaindenes (JP-A-64-19343), oxazoles (JP-A-64-26843), thiosulfonic acids (JP-A-64-79742) and indazoles (JP-A-1-137247).

Further, attempts have been made to increase the molecular weights of couplers and ultraviolet light absorbers to thereby make them nondiffusing or to reduce the amount of high-boiling organic solvents for emulsification to thereby make layers thinner. Such attempts are described in U.S. Pat. Nos. 4,080,211, 1,247,668, 3,451,820, 3,926,436, 3,767,412, 4,431,726, 4,455,368, 4,464,463 and 4,443,534.

For the purpose of recovering and removing components in processing solutions by using anion exchangers, methods are disclosed in JP-B-58-22528 (the term "JP-B" as used herein means an "examined Japanese patent publication"), JP-B-60-28767, JP-A-62-75525 and U.S. Pat. Nos. 4,348,475, 3,437,631 and 3,253,920.

However, these methods for increasing the molecular weights of the compounds have disadvantages. For example, the polymerizability of starting monomers is poor and hence compounds having a sufficiently high molecular weight cannot be obtained so that the resulting compounds are poorly nondiffusing, or the compatibility of the compounds with hydrophilic colloids (e.g., gelatin) in silver halide photographic materials are poor. When the ion exchangers are used, the efficiency of ion exchange is low in conventional methods. Accordingly, it is highly demanded to develop a novel parent material for forming high-molecular compounds.

SUMMARY OF THE INVENTION

An object of the present invention is to provide a chitosan or chitin compound capable of releasing a useful photographic reagent.

Another object of the present invention is to provide a processing method comprising processing silver halide photographic materials in the presence of said chitosan or chitin compound.

Accordingly, the present invention provides in one aspect a chitosan or chitin compound having a photographically useful residue.

The present invention provides in another aspect a method for processing a silver halide photographic material which comprises processing a silver halide photographic material comprising a support having thereon at least one light-sensitive silver halide emulsion layer in the presence of a chitosan or chitin compound having a photographically useful residue.

DETAILED DESCRIPTION OF THE INVENTION

Now, the present invention will be illustrated in more detail below. Chitosan or chitin compounds represented by the following general formula (I) are preferred.

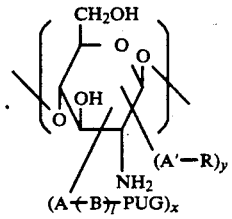

(I)

In general formula (I), A and A' represent each a bonding group which bonds hydroxyl group or amino group in glucosamine unit to B or R therethrough; B represents a divalent bonding group comprising carbon, oxygen, nitrogen, sulfur and hydrogen atoms; PUG represents a photographically useful group; R represents an alkyl group, an alkenyl group, an alkynyl group, an aralkyl group or an aryl group, each of which may have one or more substituent groups; x and y represents each a number satisfying the relationship of $0<x\leqq 3$ and $0\leqq y\leqq 3-x$; and l represents an integer of 0 or 1.

The compounds of general formula (I) are illustrated in more detail below.

A and A' represent each a bonding group which bonds hydroxyl group or amino group in glucosamine units to B or R therethrough. Examples of the bonding group include

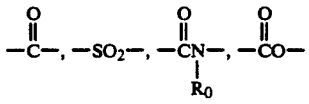

and a $C_{1-20}$, preferably $C_{1-12}$ alkylene group (e.g., methylene group, ethylene group, etc.).

Examples of the divalent bonding group represented by B include a $C_{1-20}$, preferably $C_{1-12}$ alkylene group (e.g., methylene group, ethylene group, —$CH_2CH_2NH$-CO— group, —$CH_2CH_2CH_2CONH$— group, —$CH_2CH_2SCH_2$— group, etc.), a $C_{2-20}$, preferably $C_{2-12}$ alkenylene group (e.g., propenylene group, etc.)

and a $C_{6-20}$, preferably $C_{6-12}$ arylene group (e.g., phenylene group

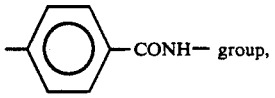

etc.), each of which may contain

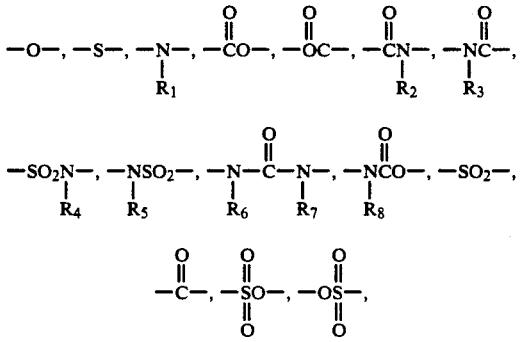

or the like.

$R_0$, $R_1$, $R_2$, $R_3$, $R_4$, $R_5$, $R_6$, $R_7$, and $R_8$ represent each hydrogen atom, a substituted or unsubstituted $C_{1-12}$, preferably $C_{1-6}$ alkyl group (e.g., methyl group, ethyl group, propyl group, n-butyl group, etc.), a substituted or unsubstituted $C_{6-20}$, preferably $C_{6-12}$ aryl group (e.g., phenyl group, 4-methylphenyl group, etc.), a substituted or unsubstituted $C_{2-12}$, preferably $C_{2-6}$ alkenyl group (e.g., propenyl group, 1-methylvinyl group, etc.) or a substituted or unsubstituted $C_{7-20}$, preferably $C_{7-12}$ aralkyl group (e.g., benzyl group, phenethyl group, etc.).

R represents a substituted or unsubstituted $C_{1-20}$, preferably $C_{1-12}$ alkyl group (e.g., methyl group, ethyl group, methoxyethyl group, etc.), a substituted or unsubstituted $C_{2-20}$, preferably $C_{2-12}$ alkenyl group (e.g., allyl group, 1-methylvinyl group, etc.), a substituted or unsubstituted $C_{2-20}$, preferably $C_{2-12}$, alkynyl group (e.g., propynyl, etc.), a substituted or unsubstituted $C_{7-20}$, preferably $C_{7-12}$ aralkyl group (e.g., benzyl group, phenethyl group, etc.) or a substituted or unsubstituted $C_{6-20}$, preferably $C_{6-12}$ aryl group (e.g., phenyl group, 4-chlorophenyl group, etc.).

Examples of the photographically useful group represented by PUG include development inhibitors, development accelerators, fogging agents, couplers, coupler-releasing couplers, diffusing or nondiffusing dyes, desilverization accelerators, desilverization inhibitors, solvents for silver halide competitive compounds, developing agents, auxiliary developing agents, fixation accelerators, fixation inhibitors, image-stabilizing agents, toning agents, processability and preservability improver, halftone dot improver, dye image stabilizers, photographic dyes, surfactants, hardening agents, ultraviolet light absorbers, fluorescent brighteners, desensitizers, high-contrast imparting agents, chelating agents and precursors thereof.

More specifically, examples of the photographically useful group include those described in JP-A-62-260153 and U.S. Pat. No. 4,684,604.

These photographically useful groups are often overlapped with one another in respect of usefulness. Typical examples thereof are illustrated below.

When PUG represents development inhibitors, the development inhibitors are conventional development inhibitors which have a hetero-atom and are attached through the hetero-atom. Examples of the development inhibitors are described in C. E. K. Mees and T. H. James, *The Theory of the Photographic Process,* the third edition, pages 344–346 (Macmillan, 1966).

More specifically, examples of the development inhibitors include compounds having a mercapto group attached to a heterocyclic ring such as substituted or unsubstituted mercaptoazoles (e.g., 5-mercaptotetrazoles, 3-mercapto-1,2,4-triazoles, 2-mercaptoimidazoles, 2-mercapto-1,3,4-thiadiazoles, 5-mercapto-1,2,4-thiadiazoles, 2-mercapto-1,3,4-oxadiazoles, 2-mercapto-1,3,4-selenadiazoles, 2-mercapto-oxazoles, 2-mercaptothiazoles, 2-mercaptobenzoxazoles, 2-mercaptobenzimidazoles, 2-mercaptobenzthiazoles, etc.), substituted or unsubstituted mercaptopyrimidines (e.g., 2-mercaptopyrimidines, etc.) and substituted or unsubstituted mercaptoazaindenes (e.g., 2-mercapto-1,3,3a,7-tetraazaindenes, etc.).

Examples of residues capable of forming iminosilver of, for example, development inhibitors, development accelerators, image-stabilizing agents, toning agents, processability and preservability improver, and halftone dot improver include substituted or unsubstituted imidazoles, substituted or unsubstituted benzimidazoles, substituted or unsubstituted benztriazoles, substituted or unsubstituted benzoxazoles, substituted or unsubstituted benzthiazoles, substituted or unsubstituted imidazoles, substituted or unsubstituted thiazoles, substituted or unsubstituted oxazoles, substituted or unsubstituted triazoles, substituted or unsubstituted tetrazoles, substituted or unsubstituted azaindenes, substituted or unsubstituted pyrazoles and substituted or unsubstituted indoles.

When PUG represents an ultraviolet light absorber, examples of ultraviolet light absorber unit include benztriazoles described in U.S. Pat. No. 3,533,794, JP-B-50-25337, JP-B-50-10726, JP-B-55-36984, U.S. Pat. No. 4,009,038, JP-A-55-50245, JP-B-49-26139, U.S. Pat. Nos. 3,253,921, 3,271,156, 3,833,380, 4,235,999, 4,236,013, 4,271,307, 4,308,194, 3,754,919, 3,794,493, 4,447,511, 3,692,525 and 3,769,294; benzophenones described in U.S. Pat. Nos. 3,284,203, 2,719,086, 2,763,657, 3,215,530, 3,785,827 and 3,123,647; cinnamic acids described in U.S. Pat. Nos. 4,200,464, 3,707,375 and 3,705,805, JP-A-57-157236 and JP-A-58-111942; stilbenes described in U.S. Pat. No. 4,336,326 and JP-A-55-99963; thiazolidones and imidazolidones described in U.S. Pat. No. 3,352,681, JP-B-50-10726, U.S. Pat. Nos. 2,719,162, 2,739,888, 2,784,087, 2,798,067, 2,875,053, 2,882,150, 3,350,204, 3,314,794 and 3,365,295; and aminobutadienes described in U.S. Pat. Nos. 4,195,999, 4,163,671 and 4,309,500, JP-B-57-37045, JP-A-53-131837, JP-A-54-18727, JP-A-53-129633, JP-A-57-157236, JP-A-57-157245, U.S. Pat. No. 4,455,368, JP-B-61-57619, JP-B-57-19771, JP-B-58-26016, JP-A-60-75834, U.S. Pat. Nos. 4,360,588, 4,359,523 and 4,359,522.

When PUG represents a color coupler, examples of coupler unit include yellow couplers described in U.S. Pat. Nos. 3,933,501, 4,022,620, 4,326,024, 4,401,752 and 4,248,961, JP-B-58-10739, U.K. Patents 1,425,020 and 1,476,760, U.S. Pat. Nos. 3,973,968, 4,314,023 and 4,511,649 and European Patent 249,473A; magenta couplers such as typically 5-pyrazolone compounds and pyrazoloazole compounds described in U.S. Pat. Nos.

4,310,619 and 4,351,897, European Patent 73,636, U.S. Pat. Nos. 3,061,432 and 3,725,064, *Research Disclosure* (RD) No. 24220 (June 1984), JP-A-60-33552, RD No. 24230 (June 1984), JP-A-60-43659, JP-A-61-72238, JP-A-60-35730, JP-A-55-118034, JP-A-60-185951, U.S. Pat. Nos. 4,500,630, 4,540,654 and 4,556,630 and WO(PCT) 88/04795; cyan couplers such as typically phenol compounds and naphthol compounds described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Laid-Open No. 3,329,729, European Patents 121,365A and 249,453A, U.S. Pat. Nos. 3,446,622, 4,333,999, 4,753,871, 4,451,559, 4,427,767, 4,690,889, 4,254,212 and 4,296,199 and JP-A-61-42658; and colored couplers for correcting unnecessary absorption of developed dyes described in RD No. 17643 (item VII-G), U.S. Pat. No. 4,163,670, JP-B-57-39413, U.S. Pat. Nos. 4,004,929 and 4,138,258 and U.K. Patent 1,146,368. Further, there can be preferably used, as PUG, couplers which release a fluorescent dye during coupling to correct unnecessary absorption of developed dyes as described in U.S. Pat. No. 4,774,181 and couplers having a dye precursor group, as an eliminable group, capable of reacting with a developing agent to form a dye as described in U.S. Pat. No. 4,777,120.

Couplers which release a photographically useful residue by coupling can be preferably used as PUG. Preferred examples of such couplers include DIR couplers which release a development inhibitor as described in patent specifications cited in the aforesaid RD 17643, item VII-F, JP-A-57-151944, JP-A-57-154234, JP-A-60-184248, JP-A-63-37346, U.S. Pat. Nos. 4,248,962 and 4,782,012.

Preferred examples of couplers which release imagewise a nucleating agent or a development accelerator during development are described in U.K. Patents 2,097,140 and 2,131,188, JP-A-59-157638 and JP-A-59-170840.

Other examples of couplers which can be used as PUG include competitive couplers described in U.S. Pat. No. 4,130,427; polyequivalent type couplers described in U.S. Pat. Nos. 4,283,472, 4,338,393 and 4,310,618; DIR redox compound-releasing couplers, DIR coupler-releasing couplers, DIR coupler-releasing redox compounds or DIR redox-releasing redox compounds described in JP-A-60-185950 and JP-A-62-24252; couplers which release a dye capable of restoring its original color after elimination described in European Patent 173,302A; couplers which release a bleaching accelerator described in RD Nos. 11449 and 24241 and JP-A-61- 201247; ligand-releasing couplers described in U.S. Pat. No. 4,553,477; couplers which release a leuco dye described in JP-A-63-75747; and couplers which release a fluorescent dye described in U.S. Pat. No. 4,774,181.

Specific examples of the compounds represented by general formula (I) according to the present invention include, but are not limited to, the following compounds.

The term "degree of substitution" as used herein refers to a degree of substitution among three groups in total of —OH and $NH_2$ groups in glucosamine (GlcN) unit.

1.

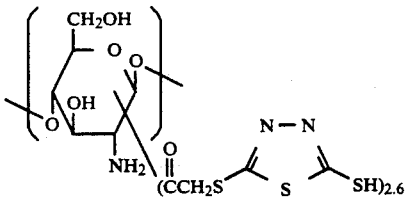

(Degree of substitution = 2.6/GlcN)

2.

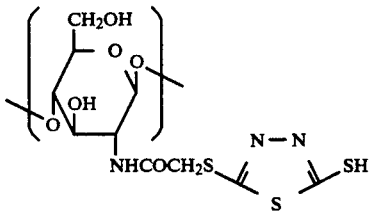

(Degree of substitution = 1.0/GlcN)

3.

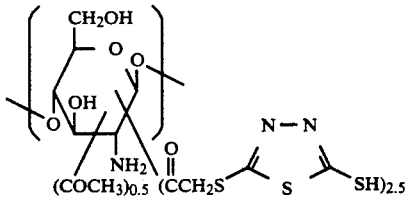

(Degree of substitution = 3.0/GlcN)

4.

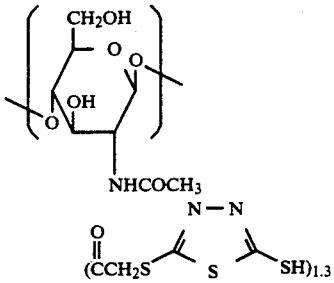

(Degree of substitution = 2.3/GlcN)

5.

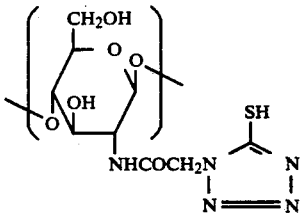

(Degree of substitution = 1.0/GlcN)

6.

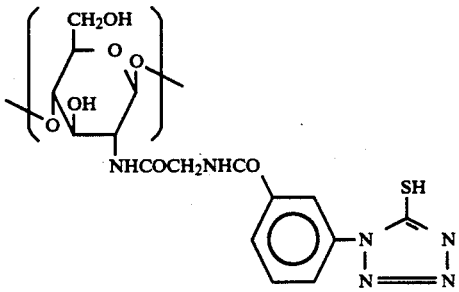

(Degree of substitution = 1.0/GlcN)

-continued
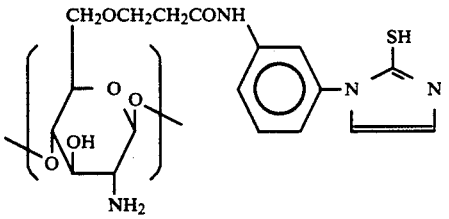
(Degree of substitution = 1.0/GlcN)
8.
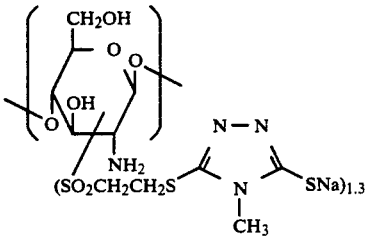
(Degree of substitution = 2.2/GlcN)
9.
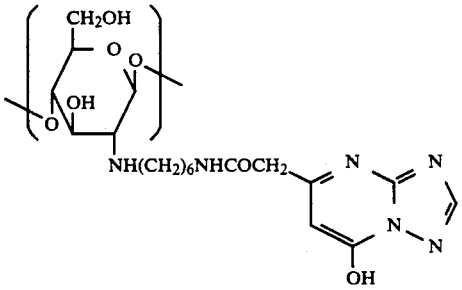
(Degree of substitution = 1.0/GlcN)
10.
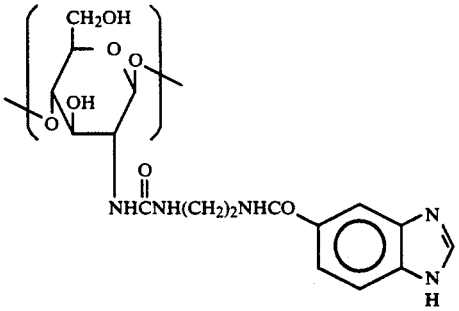
(Degree of substitution = 1.0/GlcN)
11.
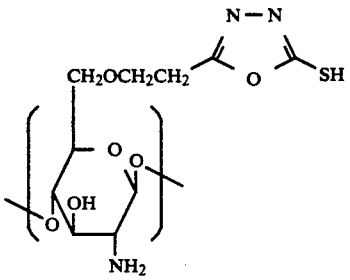
(Degree of substitution = 1.0/GlcN)
-continued
7.
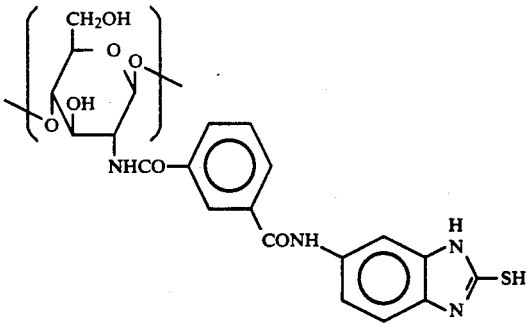
(Degree of substitution = 1.0/GlcN)
12.
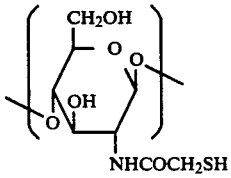
(Degree of substitution = 1.0/GlcN)
13.
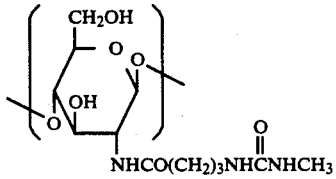
(Degree of substitution = 1.0/GlcN)
14.
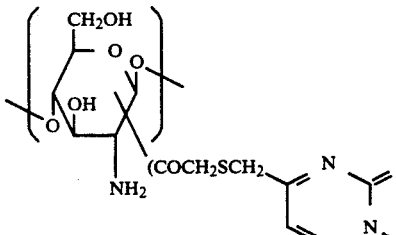
(Degree of substitution = 2.5/GlcN)
15.
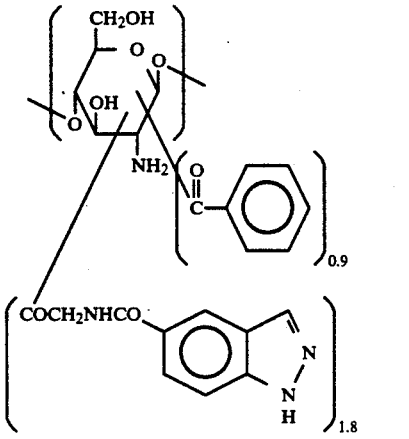
(Degree of substitution = 2.7/GlcN)
16.

-continued
17.
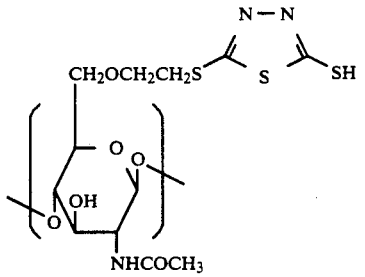
(Degree of substitution = 2.0/GlcN)
18.
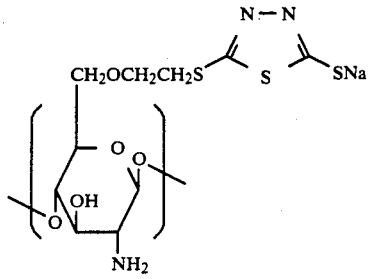
(Degree of substitution = 1.0/GlcN)
19.
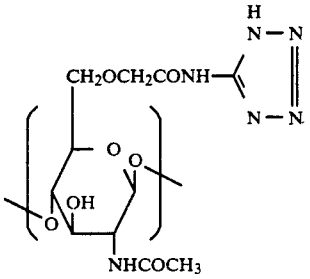
(Degree of substitution = 2.0/GlcN)
20.
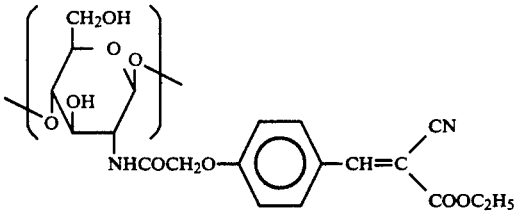
(Degree of substitution = 1.0/GlcN)
21.
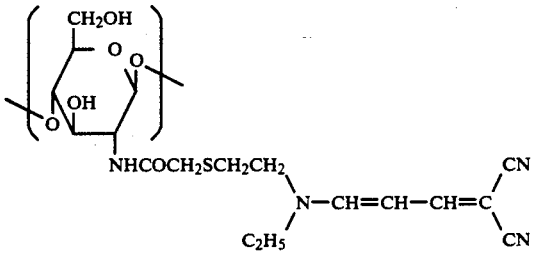
(Degree of substitution = 1.0/GlcN)
-continued
22.
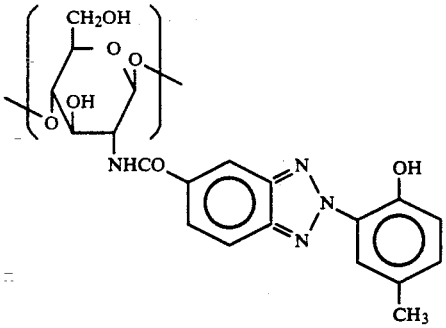
(Degree of substitution = 1.0/GlcN)
23.
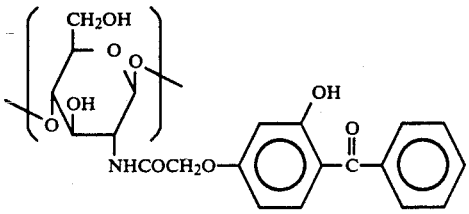
(Degree of substitution = 1.0/GlcN)
24.
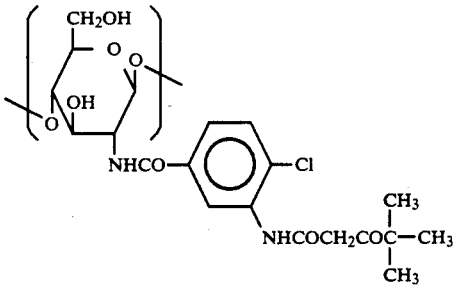
(Degree of substitution = 1.0/GlcN)
25.
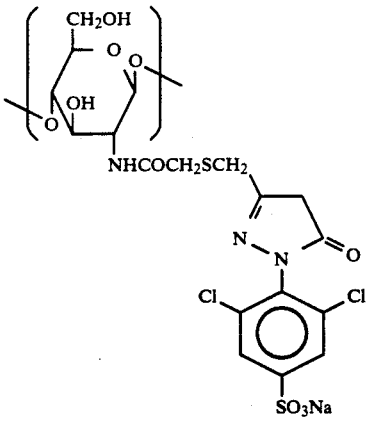
(Degree of substitution = 1.0/GlcN)
26.
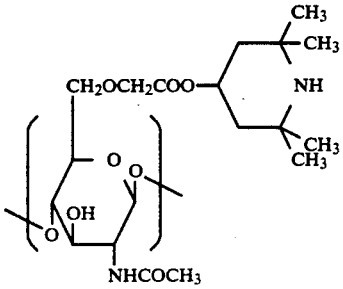

-continued (Degree of substitution = 2.0/GlcN)

27.

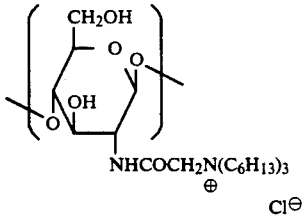

(Degree of substitution = 1.0/GlcN)

28.

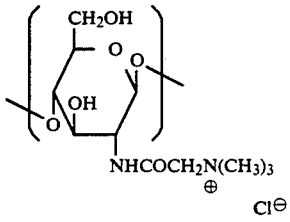

(Degree of substitution = 1.0/GlcN)

29.

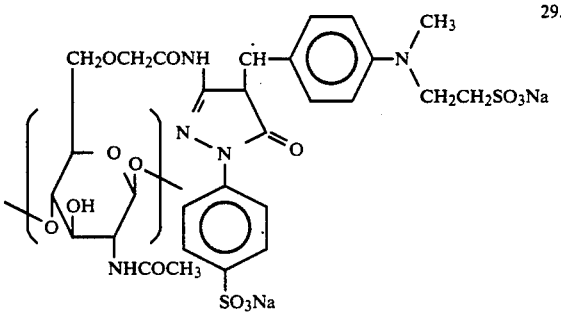

(Degree of substitution = 2.0/GlcN)

30.

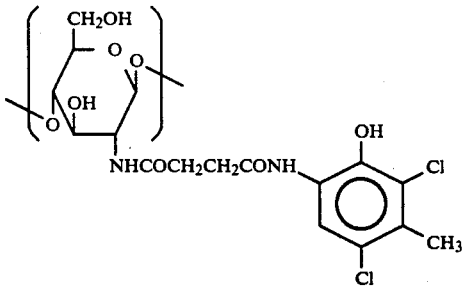

(Degree of substitution = 1.0/GlcN)

31.

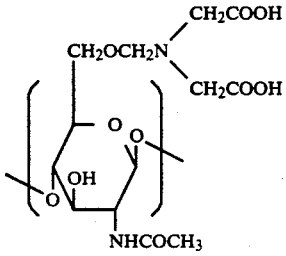

(Degree of substitution = 2.0/GlcN)

-continued

32.

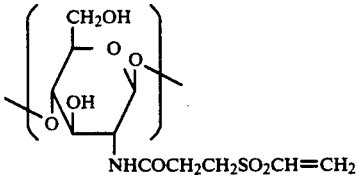

(Degree of substitution = 1.0/GlcN)

33.

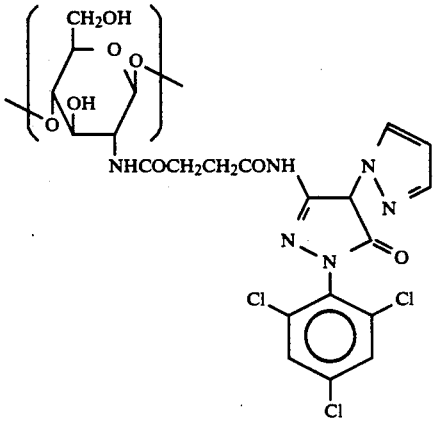

(Degree of substitution = 1.0/GlcN)

34.

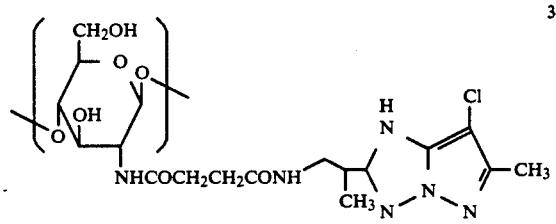

(Degree of substitution = 1.0/GlcN)

35.

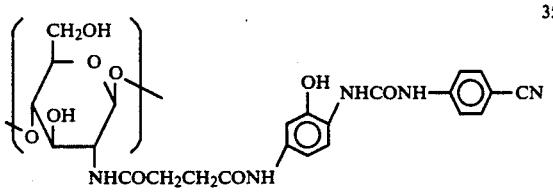

(Degree of substitution = 1.0/GlcN)

The compounds which are used in the present invention can be easily synthesized by using commercially available compounds such as chitosan and chitin (commercially readily available from Wako Junyaku Kogyo KK) as starting materials by reference to the methods described in the Journal of the Chemical Society of Japan (10) 1622–1625 (1982); *Carbohydr. Res.*, 92, 160 (1981); *Bull. Chem. Soc., Jpn.*, 41, 2723 (1968); *J. Polym. Sci., Polym. Chem. Ed.*, 19, 2361 (1981); *J. Polym. Sci, Poly. Lett. Ed.*, 17, 479 (1979); *Agric. Biol. Chem.*, 47, 1389 (1983); *Carbohydr. Res.*, 47, 315 (1976); and *Carbohydr. Res.*, 104, 235 (1982).

Synthesis examples of typical compounds will be shown below.

SYNTHESIS EXAMPLE 1

Synthesis of Compound 1

To 19 g of chitosan 100 L (molecular weight: $70\sim100\times10^4$) (a product of Wako Junyaku KK) was added 600 g of monochloroacetic acid. The mixture was heated at 70° C. to dissolve it. To the resulting solution was added 171 g of monochloroacetic anhydride and the mixture was reacted at 70° C. for 3 hours. The reaction mixture (solution) was introduced into 5 l of water. The precipitated crystal was recovered by filtration and washed with 1 l of methyl alcohol twice to obtain 35 g of chloroacetylated chitosan. The elemental analysis of the resulting crystal showed that a degree of chloroacetylation was 2.6 (degree of substitution =2.6/GlcN) from Cl/N ratio.

Separately, 30 g of 2,5-dimercapto-1,3,4-thiadiazole was dissolved in 400 ml of dimethylformamide, and 40 ml of a 28% methyl alcohol solution of sodium methoxide was added thereto. The mixture was heated at 80° C. To the heated mixture was added dropwise a solution of 17 g of the above-prepared chloroacetylated chitosan dissolved in 400 ml of dimethylformamide. The mixture was reacted at 80° C. for 3 hours, cooled to room temperature and introduced into 3 l of methyl alcohol. The precipitated crystal was collected by filtration and washed with water and methyl alcohol alternately to obtain 22 g of a light yellow crystal. The elemental analysis of the resulting crystal showed that a degree of substitution was 2.6 GlcN from S/N ratio.

SYNTHESIS EXAMPLE 2

Synthesis of Compound 2

10 g of compound 1 obtained in Synthesis example 1 was dissolved in 200 ml of 0.1 N sodium hydroxide. The resulting solution was heated at 40° C. for one hour, cooled to room temperature and neutralized with concentrated hydrochloric acid to precipitate a crystal. The crystal was collected by filtration to obtain 6.1 g of a light yellow crystal. The elemental analysis of the crystal showed that a degree of substitution was 1.0 GlcN from S/N ratio.

SYNTHESIS EXAMPLE 3

Synthesis of Compound 3

2.4 g of chloroacetylated chitosan obtained in Synthesis Example 1 and 3.8 g of thiourea were added to 200 ml of dimethylacetamide. The mixture was reacted at 80° C. for 5 hours. The precipitated crystal was collected by filtration and dissolved in 200 ml of 0.1 N sodium hydroxide. The resulting solution was heated at 40° C. for 3 hours. After reaction, concentrated hydrochloric acid was added thereto to precipitate a crystal. The crystal was collected by filtration to obtain 1.8 g of a crystal. The elemental analysis of the crystal showed that the desired product having a degree of substitution of 1.0 GlcN from S/N ratio was obtained.

The weight average molecular weights of the compounds of the present invention can be arbitrarily controlled according to purpose, but are preferably in the range of $5\times10^3$ to $3\times10^6$.

The compounds of the present invention may be added to silver halide emulsion layers or adjacent layers thereto. If desired, the compounds may be added to processing solutions.

When the compounds of general formula (I) according to the present invention are used, suitable PUG must be chosen according to purpose. The amounts of the compounds to be added vary depending on the types of the photographic materials and the processing solutions and the properties of PUG to be chosen.

Generally, when the compounds are added to the photographic materials, the amounts of the compounds to be added are preferably in the range of $1\times10^{-7}$ to $1\times10^{-3}$ mol (in terms of the photographically useful group by mol) per mol of silver halide. For example, when PUG is a restrainer, the compounds of the present invention are used in an amount of preferably $1\times10^{-7}$ to $1\times10^{-1}$ mol, particularly preferably $1\times10^{-6}$ to $5\times10^{-2}$ mol per mol of silver halide.

When the compounds of the present invention are added to the processing solutions, they may be added to developing solutions, bleaching solutions, bleaching-fixing solutions, fixing solutions and rinsing solutions according to purpose. The amounts of the compounds to be added are preferably in the range of $1\times10^{-5}$ to $1\times10^{-2}$ mol per liter of the processing solution.

The silver halide emulsions of the photographic materials of the present invention may have any halogen composition of silver iodobromide, silver bromide, silver chlorobromide, silver chloride, etc. For example, when the rapid processing of color paper is to be conducted or processing is to be conducted with a low replenishment rate, silver chlorobromide emulsions or silver chloride emulsions having a silver chloride content of not lower than 60 mol%, particularly 80 to 100 mol% are preferred. When high sensitivity is required and particularly fogging is prevented from being caused during the course of preparation, storage and/or processing, silver chlorobromide emulsions having a silver bromide content of not lower than 50 mol%, particularly not lower than 70 mol% or silver bromide emulsions (each of which may contain not higher than 3 mol% of silver iodide) are preferred. Silver iodobromide and silver chloroiodobromide are preferred for color photographic materials for photographing, the content of silver iodide being preferably 3 to 15%.

The interior and surface layer of the silver halide grain of the present invention may be composed of different phases, the grain may be composed of a polyphase structure having a joined structure, or the grain may be composed of a uniform phase throughout the grain. A mixture of grains having these phases may be used.

The silver halide grains of the present invention have a mean grain size (the average of the diameters of grains when the grains are spherical or nearly spherical; when the grains are cubic, the lengths of edges are referred to as grain sizes and the mean grain size is represented by the average thereof on the basis of the projected area of the grain; when the grains are tabular grains, the diameter of the grain is defined as the diameter of a circle having an area equal to the projected area of the grain and the average of the diameters is referred to as the mean grain size) of preferably not larger than 2 μm, but not smaller than 0.1 μm, particularly preferably not larger than 1.5 μm, but not smaller than 0.15 μm. The grain size distribution of the grains may be narrow or wide. However, there are preferred monodisperse silver halide emulsions wherein a value (a coefficient of variation) obtained by dividing standard deviation in the grain size distribution curve of a silver halide emulsion by the mean grain size is not higher than 20%, particularly preferably not higher than 15%. In emulsion layers having substantially the same color sensitivity, two or more monodisperse silver halide emulsions (as the degree of monodisperse system, grains having a coefficient of variation within the range described above being preferred) having different grain sizes can be mixed in the same layer or can be separately coated in the form of a multi-layer structure to satisfy gradation required for the photographic material. Further, two or more polydisperse silver halide emulsions or a combination of a monodisperse emulsion and a polydisperse emulsion may be used as a mixture thereof or in the form of a multilayer structure.

The silver halide grains of the present invention may have a regular crystal form such as cube, octahedron, rhombic dodecahedron or tetradecahedron, an irregular crystal form such as sphere or a composite form of these crystal forms. Further, tabular grains may be used. There can be used emulsions wherein tabular grains having a ratio of length to thickness of 5 to 8 or not lower than 8 account for at least 50% of the entire projected area of grains. Emulsions comprising a mixture of grains having these various crystal forms can also be used. These emulsions may be any of a surface latent image type wherein a latent image is predominantly formed on the surface of the grain and an internal latent image type wherein a latent image is predominantly formed in the interior of the grain.

Photographic emulsions which are used in the present invention can be prepared by the method described in *Research Disclosure,* Vol. 176, No. 17643 item I, II and III (December 1978).

The emulsions of the present invention are generally subjected to physical ripening, chemical ripening and spectral sensitization and then used. Additives used in these stages are described in *Research Disclosure,* Vol. 176, No. 17643 (December 1978) and ibid., Vol. 187, No. 18716 (November 1979) and given in the following table.

Conventional photographic additives which can be used in the present invention are described in the aforesaid two *Research Disclosures,* (RD 17643 and RD 18716) and given in the following table.

| Kind of Additives | RD 17643 | RD 18716 |
|---|---|---|
| 1. Chemical Sensitizing Agent | Page 23 | Page 648, right column |
| 2. Sensitivity Increaser | | Page 648, right column |
| 3. Spectral Sensitizing Agent | Pages 23 to 24 | Page 643, right column |
| 4. Supersensitizing Agent | | Page 649 right column |
| 5. Brightener | Page 24 | |
| 6. Antifogging Agent and Stabilizer | Pages 24 to 25 | Page 649, right column |
| 7. Coupler | Pages 25 | |
| 8. Organic Solvent | Page 25 | |
| 9. Light Absorber Filter Dye Ultraviolet Light Absorber | Page 25 to 26 | Page 649, right column to Page 650, left column |
| 10. Stain Inhibitor | Page 25 right column | Page 650, left to right column |
| 11. Dye Image Stabilizer | Page 25 | |
| 12. Hardening Agent | Page 26 | Page 651 left column |
| 13. Binder | Page 26 | Page 651 left column |
| 14. Plasticizer, Lubricant | Page 27 | Page 650 right column |
| 15. Coating Aid, Surfactant | Pages 26 to 27 | Page 650 right column |
| 16. Antistatic Agent | Page 27 | Page 650 right column |

The photographic materials of the present invention can be applied to various color and black-and-white photographic materials.

Examples thereof include color negative films for photographing (for general-purpose, movie, etc.), reversal color films (for slide, movies etc., there is included the case where no coupler is contained), color photographic paper, color positive films (for movie, etc.), reversal color photographic paper, heat-developable photosensitive materials (the details thereof are described in U.S. Pat. No. 4,500,626, JP-A-60-133449, JP-A-59-218443 and JP-A-61-238056), color photographic materials using silver dye bleach process, photographic materials for plate making (lith film, scanner film, etc.), X-ray photographic materials (for direct and indirect medical use, industrial use, etc.), black-and-white negative films for photographing, black-and-white photographic paper, micro photographic materials (for COM, microfilm), diffusion transfer color photographic materials (DTR), silver salt diffusion transfer photographic materials and print-out photographic materials.

When the photographic materials are used as color photographic materials, various couplers can be used.

The term "color coupler" as used herein refers to compounds which are coupled with the oxidation products of aromatic primary amines to form dyes. Typical examples of useful color couplers include naphthol or phenol compounds, pyrazolone or pyrazoloazole compounds and open-chain or heterocyclic ketomethylene compounds. Specific examples of these cyan, magenta and yellow couplers which can be used in the present invention are described in patent specifications cited in *Research Disclosure* (RD) No. 17643 (December 1978) item VII-D and ibid. No. 18717 (November 1979).

It is preferred that the color couplers to be incorporated in the photographic material are nondiffusing by introducing a ballast group or polymerizing them. When two equivalent type color couplers substituted by an eliminable group are used, the amount of silver to be coated can be reduced in comparison with four equivalent type color couplers wherein coupling active site is hydrogen atom. There can also be used couplers in which developed dyes are properly diffusing, non-color forming couplers, DIR couplers which release a development inhibitor during coupling reaction and couplers which release a development accelerator.

Typical examples of yellow couplers which can be used in the present invention include oil protect type acylacetamide couplers. Specific examples thereof are described in U.S. Pat. Nos. 2,407,210, 2,875,057 and 3,265,506. Two equivalent type yellow couplers are preferred in the present invention. Typical examples thereof include oxygen atom elimination type yellow couplers described in U.S. Pat. Nos. 3,408,194, 3,447,928, 3,933,501 and 4,022,620 and nitrogen atom elimination type yellow couplers described in JP-B-55-10739, U.S. Pat. Nos. 4,401,752 and 4,326,024, *Research Disclosure* No. 18053 (April 1979), U.K. Patent 1,425,020, West German Patent Laid-Open Nos. 2,219,917, 2,261,361, 2,329,587 and 2,433,812. Among them, α-pivaloylacetanilide couplers give developed dyes excellent in fastness, particularly fastness to light and α-benzoylacetanilide couplers give high color density.

Examples of magenta couplers which can be used in the present invention include oil protect type indazolone couplers, cyanoacetyl couplers, preferably 5-pyrazolone couplers and pyrazoloazole couplers such as pyrazolotriazole couplers. 5-Pyrazolone couplers having an arylamino group or an acylamino group at the 3-position are preferred from the viewpoints of the hue and color density of developed dyes. Typical examples thereof are described in U.S. Pat. Nos. 2,311,082, 2,343,703, 2,600,788, 2,908,573, 3,062,653, 3,152,896 and 3,936,015. Nitrogen atom elimination groups described in U.S. Pat. No. 4,310,619 and arylthio groups described in U.S. Pat. No. 4,351,897 are preferred as the elimination groups of two equivalent type 5-pyrazolone couplers. 5-pyrazolone couplers having a ballast group described in European Patent 73,636 give high color density.

Examples of the pyrazoloazole couplers include pyrazolobenzimidazoles described in U.S. Pat. No. 3,369,879, preferably pyrazolo[5,1-c][1,2,4]triazoles described in U.S. Pat. No. 3,725,067, pyrazolotetrazoles described in *Research Disclosure* No. 24220 (June 1984) and pyrazolopyrazoles described in *Research Disclosure* No. 24230 (June 1984). Imidazo[1,2-b]pyrazoles described in European Patent 119,741 are preferred from the viewpoints of fastness to light and low degree of secondary yellow absorption. Pyrazolo[1,5-b][1,2,4]triazoles described in European Patent 119,860 are particularly preferred.

Cyan couplers which can be used in the present invention include oil protect type naphthol couplers and phenol couplers. Typical examples of the naphthole couplers include naphthol couplers described in U.S. Pat. No. 2,474,293 and preferably oxygen atom elimination type two equivalent type naphthol couplers described in U.S. Pat. Nos. 4,052,212, 4,146,396, 4,228,233 and 4,296,200. Specific examples of the phenol couplers are described in U.S. Pat. Nos. 2,369,929, 2,801,171, 2,772,162 and 2,895,826. Cyan couplers having fastness to moisture and temperature are preferred in the present invention. Examples of such cyan couplers include phenol cyan couplers having an ethyl or higher alkyl group at the m-position of phenol nucleus described in U.S. Pat. No. 3,772,002; 2,5-diacylamino substituted phenol couplers described in U.S. Pat. Nos. 2,772,162, 3,758,308, 4,126,396, 4,334,011 and 4,327,173, West German Patent Laid-Open No. 3,329,729 and JP-A-59-166596; phenol couplers having phenylureido group at the 2-position and acylamino group at the 5-position of phenol nucleus described U.S. Pat. Nos. 3,446,622, 4,333,999, 4,451,559 and 4,427,767; and 5-amino-1-naphthol couplers described in JP-A-61-179438.

Graininess can be improved by using couplers which form properly diffusing developed dyes in combination. Examples of such dye-diffusing couplers include magenta couplers described in U.S. Pat. No. 4,366,237 and U.K. Patent 2,125,570 and yellow, magenta and cyan couplers described in European Patent 96,570 and West German Patent Laid-Open No. 3,234,533.

The dye-forming couplers and the aforesaid special couplers may form a dimer or a higher polymer. Typical examples of dye-forming polymer couplers are described in U.S. Pat. Nos. 3,451,820 and 4,080,211. Examples of magenta polymer couplers are described in U.K. Patent 2,102,173 and U.S. Pat. No. 4,367,282.

Two or more of the couplers used the present invention may be contained in the same light-sensitive layer to satisfy characteristics required for the photographic materials. If desired, the same compound may be introduced into two or more different layers.

The couplers of the present invention can be introduced into the photographic materials by conventional dispersion methods. Examples of high-boiling organic solvents used in oil-in-water dispersion method are described in U.S. Pat. No. 2,322,027. Examples of the stages and effects of latex dispersion methods and impregnating latexes are described in U.S. Pat. No. 4,199,363 and West German Patent Application Nos. (OLS) 2,541,274 and 2,541,230.

The couplers of the present invention are used in an amount of generally 0.001 to 1 mol per mol of light-sensitive silver halide. Preferably, yellow couplers are used in an amount of 0.01 to 0.5 mol, magenta couplers are used in an amount of 0.003 to 0.3 mol, and cyan couplers are used in an amount of 0.002 to 0.3 mol, each amount being per mol of silver halide.

The photographic materials of the present invention are coated on flexible supports such as conventional plastic films (e.g., cellulose nitrate, cellulose acetate, polyethylene terephthalate, etc.) and paper or rigid supports such as glass. Supports and coating methods are described in more detail in *Research Disclosure*, Vol. 176, No. 17643, item XV (page 27), item XVII (page 28) (December 1978).

For the purpose of the present invention, reflection type supports are preferable.

The term "reflection type support" as used herein refers to supports which enhance reflection properties to make a dye image formed on the silver halide emulsion layer clear. Examples of the reflection type support include supports coated with a hydrophobic resin containing a light reflecting material such as titanium oxide, zinc oxide, calcium carbonate or calcium sulfate dispersed therein and supports composed of a hydrophobic resin containing a light reflecting material dispersed therein.

There is no particular limitation with regard to the development methods of the silver halide photographic materials. For example, any of conventional methods and conventional processing solutions described in *Research Disclosure*, Vol. 176, pages 28–30 can be used. The photographic processing may be any of photographic processing for forming silver image (black-and-white photographic processing) and photographic processing for forming dye image (color photographic processing). Processing temperature is generally 18° to 50° C. However, a temperature of lower than 18° C. or higher than 50° C. may be used.

Dye image can be formed by using conventional methods such as negative positive process (e.g., described in Journal of the Society of Motion Picture and Television Engineers, Vol. 61, pages 667–701 (1953)); color reversal process wherein development is carried out by using a developing solution containing a black-and-white developing agent to form a negative silver image, uniform exposure is then conducted at least once or other suitable fogging treatment is conduct and subsequently color development is carried out to obtain a positive dye image; and silver dye bleach process wherein photographic emulsion layers containing dye image is exposed and then developed to form a silver image which is then allowed to serve as a bleaching catalyst to bleach a dye.

Color developing solutions comprise generally aqueous alkaline solutions containing color developing agents. The color developing agents include conventional primary aromatic amine developing agents such as phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamideaniline, 4-amino-3-methyl-N-ethyl-N-β-methoxyethylaniline, etc.).

In addition thereto, there can be used compounds described in L. F. A. Mason, *Photographic Processing Chemistry*, pages 226–229 (Focal Press 1966), U.S. Pat. Nos. 2,193,015 and 2,592,364 and JP-A-48-64933.

Generally, the color developing solutions contain pH buffering agents such as alkali metal sulfites, carbonates, borates and phosphates and development inhibitor or anti-fogging agents such as bromides, iodides and organic anti-fogging agents. If desired, the color developing solutions may contain water softeners, preservatives such as hydroxylamine, organic solvents such as benzyl alcohol and diethylene glycol, development accelerators such as polyethylene glycol, quaternary ammonium salts and amines, dye forming couplers, competitive couplers, fogging agents such as sodium boron hydride, auxiliary developing agents such as 1-phenyl-3-pyrazolidone, tackifiers, polycarboxylic acid chelating agents and antioxidants.

After color development, the photographic emulsion layers are generally subjected to bleaching treatment. Bleaching may be carried out simultaneously with fixing treatment, or they may be separately carried out. Examples of bleaching agents include compounds of polyvalent metals such as iron(III), cobalt(III), chromium(VI) and copper(II), peracids, quinones and nitroso compounds. Typical examples of the bleaching agents include ferricyanides; dichromates; organic complex salts of iron(III) and cobalt(III) such as complex salts of aminopolycarboxylic acids (e.g., ethylenediaminetetraacetic acid, nitrilotriacetic acid, 1,3-diaminopropanetetraacetic acid, etc.), citric acid, tartaric acid, malic acid, etc.; persulfates; permanganates; and nitrosophenols. Among them, potassium ferricyanide, (ethylenediaminetetraacetato) iron(III) sodium salt and (ethylenediaminetetraacetato) iron(III) ammonium salt are particularly preferred. (Ethylenediaminetetraacetato) iron(III) complex salt is useful for independent bleaching solutions as well as monobath bleaching-fixing solutions.

Fixing solution having conventional compositions can be used. Examples of fixing agents include thiosulfates and thiocyanates. In addition, organosulfur compounds known as compounds which function as fixing agents can be used. The fixing solutions may contain water-soluble aluminum salt as a hardening agent.

Further, buffering agents, fluorescent brighteners, chelating agents, anti-foaming agents, mildewproofing agents, etc. may be optionally added.

Usually, the silver halide color photographic materials of the present invention are subjected to washing and/or stabilization stage after desilverization such as fixing or bleaching-fixing treatment. The amount of rinsing water in the washing stage widely varies depending on the characteristics (e.g., depending on materials used such as couplers) of the photographic materials, use, the temperature of rinsing water, the number of rinsing tanks (the number of stages), replenishing system (countercurrent, direct flow) and other conditions. The relationship between the amount of water and the number of rinsing tanks in the multistage countercurrent system can be determined by the method described in *Journal of the Society of Motion Picture and Television Engineers*, Vol. 64, p. 248–253 (May 1955). The number of stages in the multi-stage countercurrent system is preferably 2 to 6, particularly preferably 2 to 4.

Developing solutions used in black-and-white photographic processing may contain conventional developing agents. Examples of the developing agents include dihydroxybenzenes (e.g., hydroquinone), 3-pyrazolidones (e.g., 1-phenyl-3-pyrazolidone) and aminophenols (e.g., N-methyl-p-aminophyenol). These developing agents may be used either alone or in combination. Generally, the developing agents contain conventional additives such as preservative, alkali agent, pH buffering agent, anti-fogging agent, etc. If desired, the developing agents may optionally contain dissolution aid, color toning agent, development accelerator, surfactant, anti-foaming agent, water softener, hardening agent, tackifier, etc.

Lith type development can be applied to the photographic emulsions of the present invention. The term "lith type development" as used herein refers to development wherein dihydroxybenzenes are usually used as developing agents and development is infectiously carried out in the presence of a low sulfite ion concentration to reproduce photographically line drawing or to reproduce photographically halftone image by halftone dots (the details thereof are described in L. F. A. Mason, *Photographic Processing Chemistry*, pages 163–165 (1966)).

The present invention is now illustrated in greater detail by reference to the following examples which, however, are not to be construed as limiting the invention in any way.

EXAMPLE 1

A silver iodobromide emulsion having a silver iodide content of 6 mol% was chemically ripened by gold and sulfur sensitization methods to the maximum sensitivity, thus obtaining a high-sensitivity silver iodobromide emulsion.

The compounds of the present invention and comparative compounds indicated in Table 1 were added to the emulsion. Further, coating aids (sodium dodecylbenzenesulfonate and sodium p-nonylphenoxypoly(ethyleneoxo)propanesulfonate) and a hardening agent (1,3-bisvinylsulfonylhydroxypropane) were added thereto. The resulting emulsion was coated on a cellulose triacetate support and dried to prepare each of samples 1 to 16.

One group of these samples was stored in a refrigerator set to 5° C. for 7 days. Another group of the samples was stored in an atmosphere at 50° C. and 20% RH for 7 days, and still another group of the samples was stored in an atmosphere at 50° C. and 80% RH for 7 days. Thereafter, these three groups of the samples were exposed (1/20 seconds) through an optical wedge by using a sensitometer and then developed with a developing solution having the following composition at 32° C. for 2 minutes. The samples were fixed, rinsed and dried in a conventional manner. Thereafter, the photographic characteristics (sensitivity, fog) of the samples were measured. The results are shown in Table 1.

The reciprocal of the logarithm of exposure amount giving a density of (Fog+0.2) is referred to herein as sensitivity. The sensitivity in terms of relative sensitivity is shown in Table 1 when the sensitivity of the sample 1 is referred to as 100.

| Composition of Developing Solution | |
|---|---|
| N-Methyl-p-aminophenol hemisulfate | 1.55 g |

-continued

| Composition of Developing Solution | |
|---|---|
| Hydroquinone | 6.0 g |
| Anhydrous sodium sulfite | 22.5 g |
| Sodium carbonate monohydrate | 39.5 g |
| Potassium bromide | 0.95 g |
| Water to make | 1 liter |

TABLE 1

| Sample No. | Compound Added | Amount Added (g/AgX-mol) | Relative Sensitivity: In Refrigerator for 7 Days | Relative Sensitivity: 50° C. 20% RH 7 Days | Relative Sensitivity: 50° C. 80% RH for 7 Days | Fogging: In refrigerator for 7 Days | Fogging: 50° C. 20% RH for 7 Days | Fogging: 50° C. 80% RH for 7 Days |
|---|---|---|---|---|---|---|---|---|
| 1 | Control | — | 100 | 150 | 64 | 0.11 | 0.35 | 0.18 |
| 2 | Comp. Comp. A | 0.01 | 91 | 135 | 60 | 0.08 | 0.25 | 0.16 |
| 3 | " | 0.03 | 83 | 113 | 54 | 0.06 | 0.23 | 0.13 |
| 4 | " | 0.05 | 70 | 90 | 50 | 0.05 | 0.22 | 0.10 |
| 5 | Comp. Comp. B | 0.03 | 94 | 138 | 61 | 0.09 | 0.26 | 0.16 |
| 6 | " | 0.05 | 90 | 118 | 58 | 0.07 | 0.24 | 0.14 |
| 7 | " | 0.10 | 85 | 105 | 52 | 0.05 | 0.22 | 0.09 |
| 8 | Comp. Comp. C | 10.1 | 100 | 147 | 62 | 0.11 | 0.34 | 0.18 |
| 9 | " | 20.2 | 98 | 146 | 61 | 0.11 | 0.33 | 0.19 |
| 10 | Invention 1 | 0.1 | 100 | 147 | 65 | 0.09 | 0.16 | 0.12 |
| 11 | " | 0.3 | 95 | 143 | 63 | 0.06 | 0.10 | 0.09 |
| 12 | Invention 2 | 0.2 | 99 | 148 | 64 | 0.09 | 0.15 | 0.11 |
| 13 | " | 0.5 | 95 | 142 | 61 | 0.06 | 0.09 | 0.08 |
| 14 | Invention 15 | 1.0 | 100 | 149 | 64 | 0.10 | 0.13 | 0.12 |
| 15 | " | 2.0 | 97 | 146 | 63 | 0.07 | 0.09 | 0.09 |
| 16 | Invention 5 | 0.3 | 96 | 144 | 63 | 0.06 | 0.10 | 0.08 |

*The amount (g) of the compound added is per mol of silver halide.

Comparative Compound A

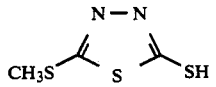

Comparative Compound B

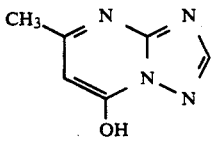

Comparative Compound C

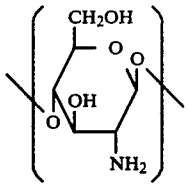

It is apparent from Table 1 that the compounds of the present invention have a good fog-inhibiting effect and a good stabilizing effect even under conditions at 50° C. and 20% for 7 days as well as conditions at 50° C. and 80% for 7 days in comparison with the comparative compounds.

EXAMPLE 2

In this Example, the diffusibility of compounds was tested.

The silver iodobromide emulsion of Example 1 was spectral-sensitized with anhydrous 5,5'-di-chloro-9-ethyl-3,3'-di(3-sulfobutyl)oxa-carbocyanine hydroxide, and only the hardening agent and the coating aids were added thereto. The resulting silver iodobromide emulsion as a green-sensitive emulsion was multi-layercoated on the emulsions of the samples prepared in Example 1. Immediately, the resulting samples were wedge-exposed through a green filter and processed in the same way as in Example 1. The resulting results are shown in Table 2.

Gamma values represent the slope of the straight line part on the characteristic curve.

TABLE 2

| Sample No. | Compound Added | Amount Added (g/AgX-mol) | By Green Exposure: Sensitivity | By Green Exposure: Fog | By Green Exposure: Gamma |
|---|---|---|---|---|---|
| 17 | Blank | — | 100 | 0.14 | 2.4 |
| 18 | Comp. Comp. A | 0.01 | 91 | 0.12 | 2.0 |
| 19 | " | 0.03 | 85 | 0.10 | 1.8 |
| 20 | " | 0.05 | 71 | 0.09 | 1.7 |
| 21 | Comp. Comp. B | 0.03 | 93 | 0.13 | 2.1 |
| 22 | " | 0.05 | 90 | 0.11 | 2.0 |
| 23 | " | 0.10 | 87 | 0.10 | 1.8 |
| 24 | Invention 1 | 0.1 | 100 | 0.14 | 2.4 |
| 25 | " | 0.3 | 99 | 0.13 | 2.3 |
| 26 | Invention 2 | 0.2 | 100 | 0.14 | 2.4 |
| 27 | " | 0.5 | 100 | 0.14 | 2.4 |
| 28 | Invention 15 | 1.0 | 100 | 0.14 | 2.4 |
| 29 | " | 2.0 | 99 | 0.14 | 2.4 |
| 30 | Invention 5 | 0.3 | 100 | 0.14 | 2.4 |

It is apparent from Table 2 that the diffusion of the compounds of the present invention is inhibited and an improvement is made, since very little effect on the photographic characteristics of the upper emulsion layer caused by the migration of the compounds from the lower layer to the upper layer by diffusion is produced when the compounds of the present invention are used.

EXAMPLE 3

A paper support (both sides thereof being laminated with polyethylene) was coated with the following layers to prepare a multi-layer color photographic paper. Coating solutions were prepared in the following manner.

Preparation of Coating Solution for First Layer 19.1 g of yellow coupler (a) and 4.4 g of dye image stabilizer (b) were dissolved in 27.2 ml of ethyl acetate and 7.9 ml of solvent (c). The resulting solution was emulsified and dispersed in 185 ml of a 10% aqueous gelatin solution containing 8 ml of 10% sodium dodecylbenzenesulfonate. Separately, $5.0\times10^{-4}$ mol of the following blue-sensitive sensitizing dye per mol of silver chlorobromide was added to a silver chlorobromide emulsion (silver bromide content: 1 mol%, Ag content: 70 g/kg) to prepare 90 g of a blue-sensitive emulsion. The resulting emulsion and the emulsified dispersion prepared above were mixed and dissolved. The concentration of gelatin was adjusted so as to give a composition given in Table 3 to prepare a coating solution for the first layer.

Coating solutions for the second layer through the seventh layer were prepared in the same way as in the preparation of the coating solution for the first layer.

Sodium salt of 1-oxy-3,5-dichloro-s-triazine was used as the hardening agent for gelatin in each layer.

The following spectal sensitizing dyes for the following emulsion layers are used.

Blue-sensitive Emulsion Layer

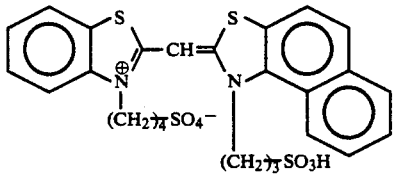

($5.0\times10^{-4}$ mol per mol of silver halide was added.)

Green-sensitive Emulsion Layer

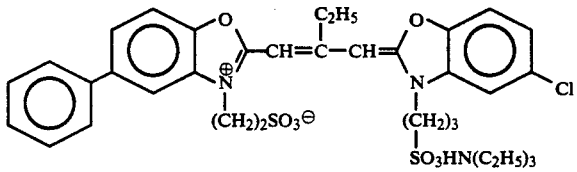

($4.0\times10^{-4}$ mol per mol of silver halide was added.)

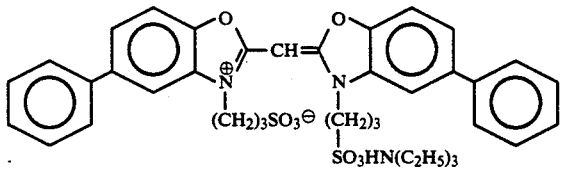

($7.0\times10^{-4}$ mol per mol of silver halide was added.)

Red-sensitive Emulsion Layer

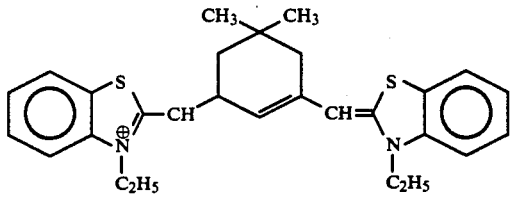

($1.0\times10^{-4}$ mol per mol of silver halide was added.)

$2.6\times10^{-3}$ mol of the following compound per mol of silver halide was added to the red-sensitive emulsion layer.

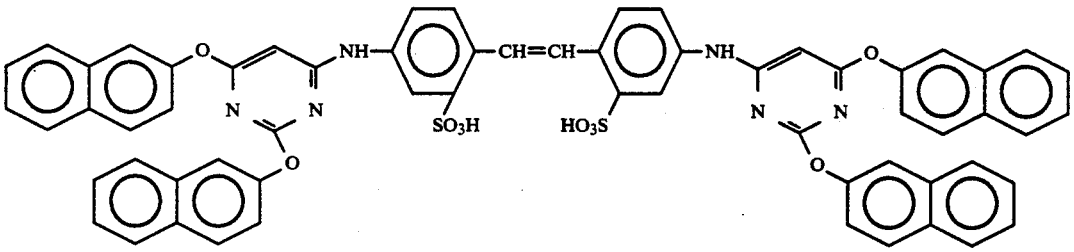

The following dye as the irradiation-preventing dye was used for the following emulsion layer Green-sensitive Emulsion Layer -continued
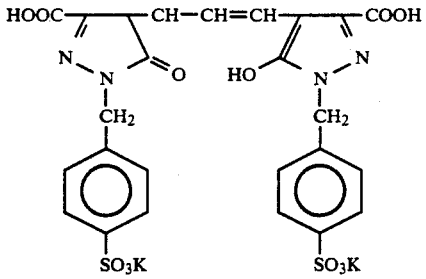
Red-sensitive Emulsion Layer
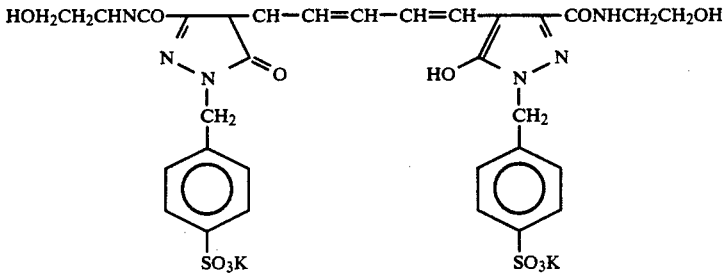
Compounds such as couplers used in this Example have the following structural formulae.
(a) Yellow Coupler:
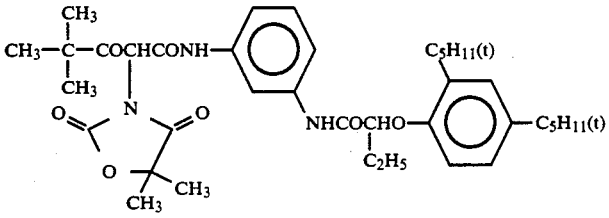
(b) Dye Image Stabilizer:
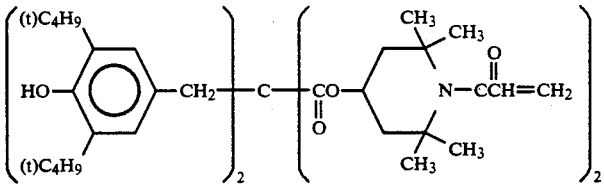
(c) Solvent:
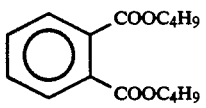
(d) Color Mixing Inhibitor
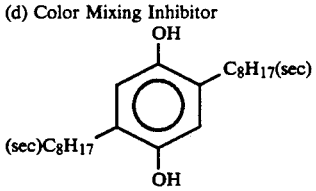
(e) Solvent:
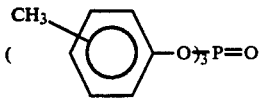
(f) Dye Image Stabilizer:
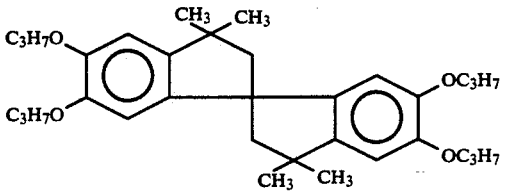
(g) Solvent:

-continued
$(C_8H_{17}O)_3P{=}O$ and (
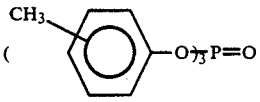
2:1 mixture (by weight)
(h) Ultraviolet Light Absorbent
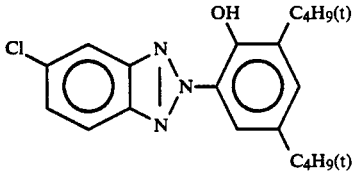
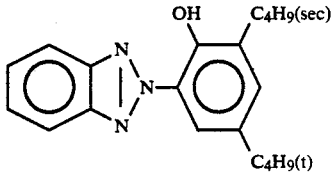
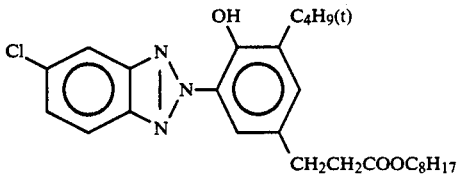
(i) Color Mixing Inhibitor
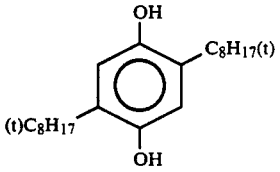
(j) Solvent
$(isoC_9H_{19}O)_3P{=}O$
(k) Cyan Coupler:
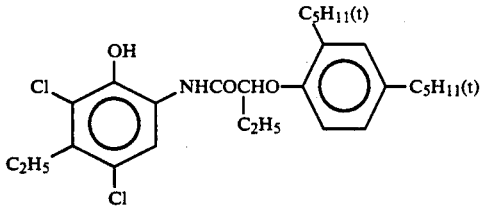
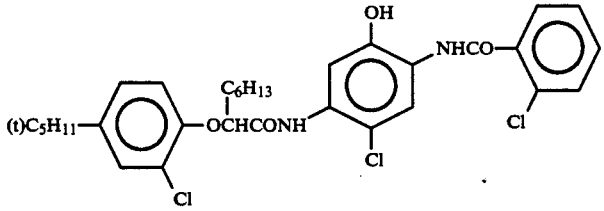
1:1 mixture (by mol)
(l) Dye Image Stabilizer
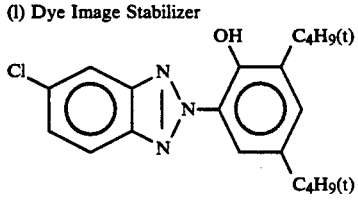

-continued

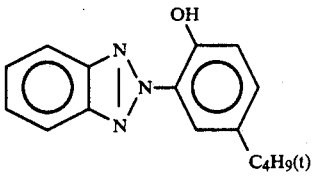

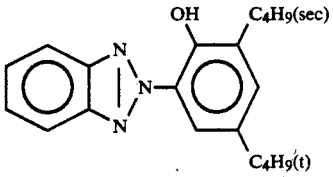

1:3:3 mixture (by mol)

(m) Magenta Coupler:

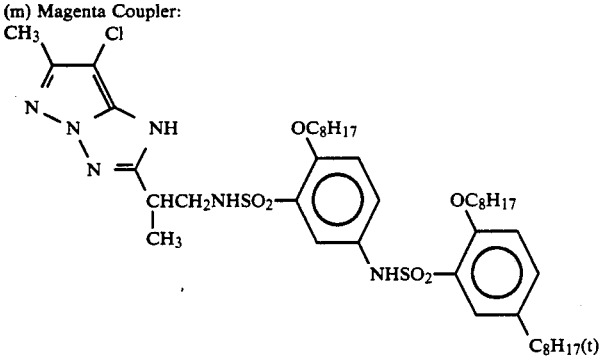

TABLE 3

| Layer | Principal Composition | Amount Used |
|---|---|---|
| Seventh Layer (Protective Layer | Gelatin | 1.33 g/m$^2$ |
| | Acrylic-modified copolymer of polyvinyl alcohol (degree of modification: 17%) | 0.17 g/m$^2$ |
| Sixth Layer (Ultra-violet Light Absorbing Layer) | Gelatin | 0.54 g/m$^2$ |
| | Ultraviolet light absorber (h) | 0.21 g/m$^2$ |
| | Solvent (i) | 0.09 cc/m$^2$ |
| Fifth Layer (Red-sensitive Layer) | Silver chlorobromide emulsion (silver bromide content: 0.5 mol %) in terms of silver | 0.26 g/m$^2$ |
| | Gelatin | 0.98 g/m$^2$ |
| | Cyan coupler (k) | 0.38 g/m$^2$ |
| | Dye image stabilizer (l) | 0.17 g/m$^2$ |
| | Solvent (m) | 0.23 cc/m$^2$ |
| Fourth Layer (Ultra-violet light absorbing Layer) | Gelatin | 1.60 g/m$^2$ |
| | Ultraviolet light absorber (h) | 0.62 g/m$^2$ |
| | Color mixing inhibitor (i) | 0.05 g/m$^2$ |
| | Solvent (j) | 0.26 cc/m$^2$ |
| Third Layer (Green-sensitive Layer) | Silver chlorobromide emulsion (silver bromide content: 0.5 mol %) in terms of silver | 0.16 g/m$^2$ |
| | Gelatin | 1.80 g/m$^2$ |
| | Magenta coupler (e) | 0.48 g/m$^2$ |
| | Dye image stabilizer (f) | 0.20 g/m$^2$ |
| | Solvent | 0.68 cc/m$^2$ |
| Second Layer (Color Mixing Inhibiting Layer | Gelatin | 0.99 g/m$^2$ |
| | Color mixing inhibitor (d) | 0.08 g/m$^2$ |
| First Layer (Blue-sensitive Layer) | Silver chlorobromide emulsion (silver bromide content: 1 mol %) in terms of silver | 0.30 g/m$^2$ |
| | Gelatin | 1.86 g/m$^2$ |
| | Yellow coupler (a) | 0.82 g/m$^2$ |
| | Dye image stabilizer (b) | 0.19 g/m$^2$ |
| | Solvent (c) | 0.34 cc/m$^2$ |
| Support | Polyethylene-laminated paper [polyethylene on the first side contains white pigment ($TiO_2$) and bluish dye (ultramarine)] | |

The blue-sensitive layer (the first layer) and the green-sensitive layer (the third layer) (both layers being the above-described silver halide emulsion layers) were stabilized by adding 3 g of 4-hydroxy-6-methyl-1,3,3a,7-tetraazaindene and 10 mg of 1-phenyl-5-mercaptotetrazole as the conventional stabilizers thereto after the addition of the sensitizing dyes, each amount being per mol of silver halide.

The red-sensitive emulsion layer (the fifth layer) was adjusted by adding the comparative compound and the compound of the present invention as in Table 4 below before the addition of the coupler (k), and then coated on the fourth layer.

The resulting multi-layer color photographic material was treated under high temperature and humidity conditions to carry out a test on preservability in the same way as in Example 1. The sample was then exposed through an optical wedge and subjected to the following color development.

| Processing Stage | Temp. | Time |
|---|---|---|
| Color development | 35° C. | 45 sec |
| Bleaching-fixing | 35° C. | 45 sec |
| Rinse 1 | 35° C. | 20 sec |
| Rinse 2 | 35° C. | 20 sec |
| Rinse 3 | 35° C. | 20 sec |
| Drying | 80° C. | 60 sec |

Three tank countercurrent system of from rinse 3 to rinse 1 was used.

Each processing solution had the following composition.

| Color Developing Solution | Solution |
|---|---|
| Hydroxylamine | 0.04 mol |
| Benzyl alcohol | 15 ml |
| Diethylene glycol | 10 ml |
| Sodium sulfite | 0.2 g |
| Potassium carbonate | 30 g |
| EDTA.2Na | 1 g |
| Sodium chloride | 1.5 g |
| 4-Amino-3-methyl-N-ethyl-N-[β-(methanesulfonamido)ethyl]-p-phynelenediamine sulfate | 5.0 g |
| Brightener (4,4'-diaminostilbene type) | 3.0 g |
| Water to make | 1000 ml |
| pH | 10.05 |
| **Bleachin-fixing Solution** | |
| EDTA Fe(III)$NH_4$.2$H_2O$ | 60 g |
| EDTA.2Na.2$H_2O$ | 4 g |
| Ammonium thiosulfate (70%) | 120 ml |
| Sodium sulfite | 16 g |
| Glacial acetic acid | 7 g |
| Water to make | 1000 ml |
| pH | 5.5 |
| **Rinsing Solution** | |
| Formalin (37%) | 0.1 ml |
| 1-Hydroxyethylidene-1,1-diphosphonic acid (60%) | 1.6 ml |
| Bismuth chloride | 0.35 g |
| Ammonia water (26%) | 2.5 ml |
| Nitrilotriacetic acid.3Na | 1.0 g |
| EDTA.4H | 0.5 g |
| Sodium sulfite | 1.0 g |
| 3-Chloro-2-methyl-4-isothiazoline-3-one | 50 mg |
| Water to make | 1000 ml |

-continued

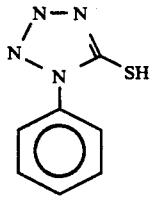

Comparative Compound D

Comparative Compound E

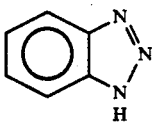

Comparative Compound F
(compound described in JP-A-62-949)

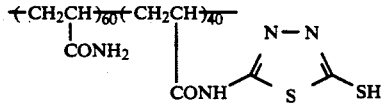

Comparative Compound G
(compound described in JP-A-59-90844)

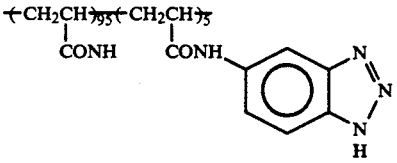

Table 4 shows the results of storage test by which an effect of the compounds of the present invention on the red-sensitive layer was examined.

It is apparent from Table 4 that the compounds of the present invention do not cause the deterioration of the photographic characteristics even under severe storage conditions and have a fog-inhibiting effect with little desensitization.

Further, it is clear that the compounds of the present invention are superior in effect even to conventional high-molecular compounds such as comparative compounds F and G.

As clear from the above-described examples, there can be obtained silver halide photographic materials which scarcely cause fogging or a lowering in sensitivity and gamma value even under severe storage conditions according to the present invention. Further, there can be provided multi-layer photographic materials in which an adverse effect is not produced by diffusion in adjacent layers.

TABLE 4

| Sample No. | Compound Added | Amount Added (5th Layer) (g/AgX-mol) | Stored in Refrigerator at 50° C. for 7 Days Fog | Sensitivity | 50° C., 20% RH 7 Days Fog | Sensitivity | 50° C., 80% RH 7 Days Fog | Sensitivity |
|---|---|---|---|---|---|---|---|---|
| 31 | blank | — | 0.31 | 100 | 0.45 | 115 | 0.31 | 85 |
| 32 | Comp. Comp. A | 0.01 | 0.18 | 95 | 0.35 | 113 | 0.28 | 84 |
| 33 | Comp. Comp. D | 0.01 | 0.19 | 97 | 0.32 | 112 | 0.27 | 83 |
| 34 | Comp. Comp. E | 0.08 | 0.24 | 99 | 0.39 | 116 | 0.29 | 86 |
| 35 | Comp. Comp. F | 0.02 | 0.19 | 94 | 0.36 | 113 | 0.28 | 83 |
| 36 | Comp. Comp. G | 1.03 | 0.26 | 99 | 0.42 | 115 | 0.30 | 84 |
| 37 | Invention 2 | 0.10 | 0.14 | 99 | 0.22 | 104 | 0.18 | 104 |
| 38 | Invention 3 | 0.08 | 0.12 | 97 | 0.19 | 101 | 0.19 | 99 |
| 39 | Invention 6 | 0.11 | 0.13 | 101 | 0.19 | 105 | 0.19 | 99 |
| 40 | Invention 13 | 0.12 | 0.15 | 97 | 0.24 | 103 | 0.20 | 97 |
| 41 | Invention 10 | 1.20 | 0.17 | 101 | 0.23 | 106 | 0.20 | 98 |

While the invention has been described in detail and with reference to specific embodiments thereof, it will be apparent to one skilled in the art that various changes and modifications can be made therein without departing from the spirit and scope thereof.

What is claimed is:

1. A method for processing a silver halide photographic material which comprises processing a silver halide photographic material comprising a support having thereon at least one light-sensitive silver halide emulsion layer in the presence of a chitosan or chitin compound having a photographically useful group; wherein said chitosan or chitin compound having a photographically useful group is a compound represented by the following general formula (I)

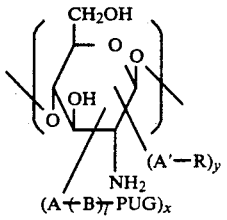

(I)

wherein A and A' each represent a bonding group which bonds a hydroxy group or an amino group in a glucosamine unit to B or R therethrough; B represents a bonding group comprising carbon, oxygen, nitrogen, sulfur and hydrogen atoms; R represents an alkyl group, an alkenyl group, an alkynyl group, an aralkyl group or an aryl group, each of which may optionally have one or more substituent groups; x and y represent each a number satisfying the relationship of $0<x\leqq 3$ and $0\leqq y\leqq 3-x$; and l represents an integer of 0 or 1; and PUG represents a photographically useful group, selected from the group consisting of a development inhibitor, a coupler, an ultraviolet light-absorber, a chelating agent, a diffusable dye, a non-diffusable dye, a hardening agent, and a fixation accelerator.

2. A method for processing a silver halide photographic material as claimed in claim 1, wherein:

(a) A and A' each represent a bonding group which bonds a hydroxyl group or an amino group in a glucosamine unit to B or R, wherein said binding group is

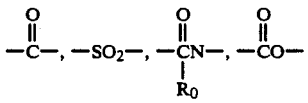

or a $C_{1-20}$ alkylene group;

(b) B represents a divalent bonding group wherein said divalent bonding group is $C_{1-20}$ alkylene group, a $C_{2-20}$ alkenylene group, or a $C_{6-20}$ arylene group, each of which may contain

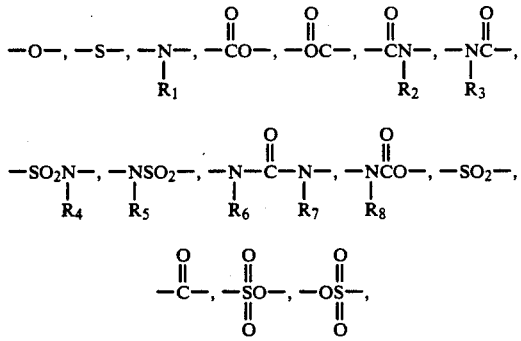

wherein $R_0$, $R_1$, $R_2$, $R_3$, $R_4$, $R_5$, $R_6$, $R_7$, and $R_8$ each represent a hydrogen atom, a $C_{1-12}$ alkyl group, a $C_{6-20}$ aryl group, A $C_{2-12}$ alkenyl group, or a $C_{7-20}$ aralkyl group, (c) R represents a $C_{1-20}$ alkyl group, a $C_{2-20}$ alkenyl group, a $C_{7-20}$ aralkyl group or a $C_{6-20}$ aryl group.

3. A method for processing a silver halide photographic material as claimed in claim 1, wherein said photographically useful group is a development inhibitor, and said development inhibitor is a mercaptoazole, a mercaptopyrimidine, or mercaptoazaindene.

4. A method for processing a silver halide photographic material as claimed in claim 3, wherein said photographically useful group is a development inhibitor, and said development inhibitor is a 5-mercaptotetrazole, a 3-mercapto-1,2,4-triazole, a 2-mercaptoimidazole, a 2-mercapto-1,3,4-thiadiazole, a 5-mercapto-1,2,4-thiadiazole, a 2-mercapto-1,3,4-oxadiazole, a 2-mercapto-1,3,4-selenadiazole, a 2-mercapto-oxazole, a 2-mercaptothiazole, a 2-mercaptobenzoxazole, a 2-mercaptobenzimidazole, a 2-mercaptobenzthiazole, a 2-mercaptopyrimidine, or a 2-mercapto-1,3,3a,7-tetrazaindene.

5. A method for processing a silver halide photographic material as claimed in claim 1, wherein the average molecular weight of said chitosan or chitin compound having a photographically useful group is from $5\times10^3$ to $3\times10^6$.

6. A method for processing a silver halide photographics material as claimed in claim 1, wherein said chitosan or chitin compound having a photographically useful group is present in the processing solution in an amount from $1\times10^{-5}$ to $1\times10^{-2}$ mol per liter.

* * * * *